US010732576B2

(12) United States Patent
Mautner et al.

(10) Patent No.: US 10,732,576 B2
(45) Date of Patent: Aug. 4, 2020

(54) METHOD FOR CALIBRATING A TIME-TO-DIGITAL CONVERTER SYSTEM AND TIME-TO-DIGITAL CONVERTER SYSTEM

(71) Applicant: ams AG, Premstaetten (AT)

(72) Inventors: Christian Mautner, Premstaetten (AT); Kerry Glover, Premstaetten (AT); Friedrich Bahnmueller, Premstaetten (AT)

(73) Assignee: ams AG, Premstaetten (AT)

( * ) Notice: Subject to any disclaimer, the term of this patent is extended or adjusted under 35 U.S.C. 154(b) by 0 days.

(21) Appl. No.: 16/477,265

(22) PCT Filed: Dec. 8, 2017

(86) PCT No.: PCT/EP2017/082081
§ 371 (c)(1),
(2) Date: Jul. 11, 2019

(87) PCT Pub. No.: WO2018/137830
PCT Pub. Date: Aug. 2, 2018

(65) Prior Publication Data

US 2019/0361404 A1 Nov. 28, 2019

Related U.S. Application Data

(60) Provisional application No. 62/450,442, filed on Jan. 25, 2017.

(30) Foreign Application Priority Data

Feb. 13, 2017 (EP) ..... 17155828

(51) Int. Cl.
*G04F 10/00* (2006.01)

(52) U.S. Cl.
CPC ..... *G04F 10/005* (2013.01)

(58) Field of Classification Search
CPC ..... G04F 10/005; H03M 1/50; H03M 1/60
(Continued)

(56) References Cited

U.S. PATENT DOCUMENTS 6,754,613 B2 * 6/2004 Tabatabaei ..... G04F 10/00 702/189
8,040,269 B2 10/2011 Bogaerts
(Continued)

FOREIGN PATENT DOCUMENTS

TW 201324325 6/2013
TW 20160883 1/2016
(Continued)

OTHER PUBLICATIONS

European Patent Office, International Search Report for PCT/EP2017/082081 dated Dec. 8, 2017.

*Primary Examiner* — Khai M Nguyen
(74) *Attorney, Agent, or Firm* — Fish & Richardson P.C.

(57) ABSTRACT

A time-to-digital converter system has at least one time-to-digital converter comprising an oscillator, a counter being driven by the oscillator, an evaluation block connected to the counter and configured for determining a time difference associated with a start signal and a stop signal, and a histogram block with a number of bins for recording entries associated with the time difference. The system can be calibrated by operating or preparing to operate the time-to-digital converter system with a measurement clock signal defining a measurement interval, providing a calibration clock signal having a frequency higher than the measurement clock signal by a predefined ratio, using a selected clock edge of the calibration clock signal as the start signal and a subsequent clock edge of the calibration clock signal as the stop signal. The evaluation block determines a cali-
(Continued)

bration time difference based on the respective clock edges of the calibration clock signal used as the start signal and the stop signal. A time measure associated with a counter step of the counter is determined based on the predefined ratio and the calibration time difference.

15 Claims, 2 Drawing Sheets

(58) Field of Classification Search
USPC ..... 341/120, 152, 157, 166
See application file for complete search history.

(56) References Cited

U.S. PATENT DOCUMENTS

| | | | | |
|---|---|---|---|---|
| 8,228,219 | B2 * | 7/2012 | Henzler ..... | G04F 10/005 341/120 |
| 2005/0119846 | A1 | 6/2005 | Mori | |
| 2012/0249195 | A1 | 10/2012 | Guo | |
| 2016/0337055 | A1 | 11/2016 | Ravi et al. | |

FOREIGN PATENT DOCUMENTS

| | | |
|---|---|---|
| TW | 201631900 | 9/2016 |
| TW | 1574510 | 3/2017 |
| TW | 1575884 | 3/2017 |

* cited by examiner

METHOD FOR CALIBRATING A TIME-TO-DIGITAL CONVERTER SYSTEM AND TIME-TO-DIGITAL CONVERTER SYSTEM

SUMMARY OF THE INVENTION

The present disclosure relates to calibration of a time-to-digital converter system, e.g. time-to-digital converter systems employing oscillators.

A time-to-digital converter (TDC) is a device used to measure a time interval and convert it into digital output. It allows measurements of very short times at high resolution.

A TDC may be used in time-of-flight cameras, for example, to measure the time an emitted light signal like a laser pulse needs to travel to a reflecting object and back to the camera.

A well-known technique to implement a TDC uses an oscillator, in particular a ring oscillator and a counter that is being driven by this oscillator, e.g. by a clock edge progressing through the ring oscillator. Such TDC may convert a time difference between respective START and STOP pulses into integer values. These values are then used as addresses for bins in a histogram memory. A downside of this design is that a physical representation of the bin address, e.g. a time difference or a spatial distance, depends on the speed or frequency of the oscillator, which may not be known in advance or may be even varying under different conditions.

In conventional approaches, the relationship between bin address and physical representation is determined by measuring reference distances.

SUMMARY OF THE INVENTION

The present disclosure provides an improved calibration concept for time-to-digital conversion that provides a higher accuracy.

For example, a time-to-digital converter system includes one or more oscillators, e.g. ring oscillators, a counter associated with and being driven by each oscillator, an evaluation block connected to each counter and configured for determining a time difference associated with a start signal and a stop signal, and a histogram block with a number of bins for recording entries associated with the time difference. Such a time-to-digital converter system is operated with a measurement clock signal defining a measurement interval. For example, the measurement clock signal drives a radiation-emitting device like a VCSEL diode such that a response or reflection of the emitted radiation, e.g. a light pulse, can be recorded. The measurement interval is usually chosen to match a measurement range of the one or more TDCs.

The improved calibration concept is based on the idea that a calibration clock signal is provided to the TDC system that has a frequency higher than the measurement clock signal, e.g. by a predefined ratio that is known.

Due to the higher frequency of the calibration clock signal, at least two clock edges of the calibration clock signal fall within the measurement interval defined by the measurement clock signal and hence within the measurement range of the TDC. These at least two clock edges of the calibration clock signal can be used to drive the evaluation block with respective start and stop signals, thereby generating a counter difference, respectively histogram bin address associated with the well-defined clock edges of the calibration clock signal. As a consequence, a time measure associated with a counter step of the counter can be determined, thus having a calibration value for the histogram entries.

If the frequency or ratio of the calibration clock signal is chosen such that at least three clock edges fall within one measurement interval, it is also possible to perform two different measurements on respective clock edge pairs of the calibration clock signal and to evaluate the results thereof in a differential manner, thereby eliminating e.g. offset effects associated with the measurement.

In an embodiment of a method for calibrating a time-to-digital converter system as outlined before, the time-to-digital converter system is operated or prepared to be operated with a measurement clock signal defining a measurement interval. According to the improved calibration concept, a calibration clock signal is provided having a frequency higher than the measurement clock signal by a predefined ratio. A selected clock edge of the calibration clock signal is used as a start signal for the evaluation block, and a subsequent clock edge of the calibration clock signal is used as a stop signal for the evaluation block. The evaluation block determines a calibration time difference based on the respective clock edges of the calibration clock signal used as the start signal and the stop signal. A time measure associated with a counter step of the counter is determined based on the predefined ratio and the calibration time difference.

Depending on the frequency, respectively ratio of the calibration clock signal, the subsequent clock edge used as the stop signal may be a clock edge being immediately subsequent to the clock edge used as the start signal. However, if the frequency or ratio is high enough, some intermediate clock edges may be, so to say, left out under the condition that a time difference between the start signal and the stop signal is shorter than the measurement interval.

In various implementations of the method, a bin number of the histogram block may be determined based on the calibration time difference, and the time measure is determined based on the predefined ratio and the determined bin number. Hence, for example a more direct relationship between the bin entries in the histogram block and an actual time measure associated with the histogram bins may be established.

In some implementations where the predefined ratio is at least two, a further subsequent clock edge of the calibration clock signal is used as a further stop signal. The further subsequent clock edge is different from the subsequent clock edge. The evaluation block determines a further calibration time difference based on the respective clock edges of the calibration clock signal used as the start signal and the further stop signal. A further bin number of the histogram block is determined based on the further calibration time difference. The time measure associated with the counter step of the counter is determined based on the predefined ratio and on a difference between the determined further bin number and the determined bin number.

For example, as the ratio is known, also a time difference between the stop signal, which can also be called a first stop signal, and the further stop signal is known. If any systematic errors like offset errors are present in the system, both the bin number associated with the first stop signal and the bin number associated with the further stop signal are affected by such systematic errors. By forming the difference between the two bin numbers, such systematic errors at least partially cancel out each other.

While the improved calibration concept will work with any predefined ratio being greater than one, it may be expedient to use predefined ratios of at least two, at least three or at least four. For ease of operation it may also be expedient to choose an integer value for the predefined ratio. This allows, for example, deriving the calibration clock signal and the measurement clock signal from each other, for example by frequency multipliers or dividers, which is more convenient in each case. To this end the predefined ratio may be chosen as an integer value being a power of two.

Whereas in the previous explanations the improved calibration concept was described in conjunction with a single time-to-digital converter, the improved calibration concept can be easily extended to systems with more than one time-to-digital converter. This will be explained in more detail in the following, taking a second time-to-digital converter as an example. However, it will be apparent to the skilled person that a greater number of time-to-digital converters, e.g. three, four or even more, can be deduced in an analog fashion.

Hence, in several implementations, the TDC system includes a second time-to-digital converter comprising a second oscillator, e.g. a ring oscillator, that is independent of the oscillator of the at least one time-to-digital converter, a second counter being driven by the second oscillator, a second evaluation block connected to the second counter and configured for determining a second time difference associated with a second start signal and a second stop signal, and a signal histogram block with a number of bins for recording entries associated with the second time difference. In such a configuration, the selected clock edge or a further clock edge of the calibration clock signal may be used as the second start signal and a corresponding subsequent clock edge of the calibration clock signal is used as the second stop signal. The definitions of the term "subsequent" as explained above also apply here. The second evaluation block determines a second calibration time difference based on the respective clock edges of the calibration clock signal used as the second start signal and the second stop signal. A second time measure is determined associated with a second counter step of the second counter based on the predefined ratio and the second calibration time difference.

Accordingly, independent time measures are determined for the first time-to-digital converter and the second time-to-digital converter, allowing alignment of the results of measurements performed with the time-to-digital converters.

For example, similar to the implementation described for the first time-to-digital converter, a second bin number of the second histogram block can be determined based on the second calibration time difference, and the second time measure can be determined based on the predefined ratio and the determined second bin number. The time measures may be used as a basis for determining calibration factors, e.g. related to a common time base.

In some of such implementations, recorded entries in the histogram block are aligned with recorded entries in the second histogram block based on the determined time measure and the determined second time measure. Such alignment may be performed during reading out the entries in the first and the second histogram block. For example, while the histogram entries are denoted with integer bin numbers, the aligned results may be referenced to non-integer addresses, depending on the value of the time measures respectively calibration factors.

It should be apparent to the skilled reader that also for the second time-to-digital converter, the calibration measurement can be performed by employing a further subsequent clock edge of the calibration signal as a further stop signal in order to determine a difference between different bin numbers in the second histogram block, as explained in detail before for the first time-to-digital converter. This also applies to further time-to-digital converters that can be implemented with the TDC system.

In the various implementations described above, the time measure may be a time span determined based further on a frequency value of the calibration clock signal, i.e. not only on the predefined ratio.

The frequency value of the calibration clock signal may be determined based on a high precision clock signal, e.g. a pulse-per-second, PPS, signal, which may be provided by a GPS receiver or is provided or derived from a crystal oscillator.

In all of the implementations the calibration result of the improved calibration concept, i.e. the time measure, can be used to convert a histogram result into units of time and further on into units of length, if appropriate. To this end, the calibration measurement may be performed in conjunction with or in relation to an actual measurement with the TDC system in order to have actual measurement results in the histogram block and to have the time measure, i.e. calibration result, when reading out the measurement results from the histogram block.

In all of the implementations described above, the determination of the calibration time difference and the determination of the time measure based thereon may be performed repeatedly, and a mean time measure may be determined from this repeated determination. Such repeated determination increases the accuracy and the reliability of the measurement result. Hence, evaluation of measurement entries in the histogram block or histogram blocks may be performed based on the mean time measure.

The improved calibration concept may also be employed in a TDC system as described above which additionally includes a calibration block that is configured for carrying out the method according to one of the implementations described above.

For example, the calibration block is configured for providing a selected clock edge of a calibration clock signal which has the frequency higher than the measurement clock signal by a predefined ratio to the evaluation block as the start signal and subsequent clock edge of the calibration clock signal as a stop signal. The calibration block is further configured for receiving from the evaluation block a calibration time difference based on the respective clock edges of the calibration clock signal used as the start signal and the stop signal and for determining a time measure associated with a counter step of the counter based on the predefined ratio and the calibration time difference.

In some implementations the calibration block is further configured for employing a further subsequent clock edge for a second measurement, as described above in detail for the method according to the improved calibration concept.

Similarly, the calibration block may also be configured for use with two or more time-to-digital converters with respective oscillators, counters etc. as described above, in order to independently determine a second or further time measure associated with a counter step of the counter of the one or more time-to-digital converters. In such configurations, the calibration block may be further configured for aligning recorded entries in the two or more histogram blocks based on the determined time measures.

Further implementations of the time-to-digital converter system become apparent to the skilled person from the descriptions of the various implementations of the calibration method above.

BRIEF DESCRIPTION OF THE DRAWINGS

The improved timing concept will be explained in more detail in the following with the aid of the drawings. Elements having the same or similar function bear the same reference numerals throughout the drawings. Hence their description is not necessarily repeated in following drawings.

In the drawings.

DETAILED DESCRIPTION

Figure 1:
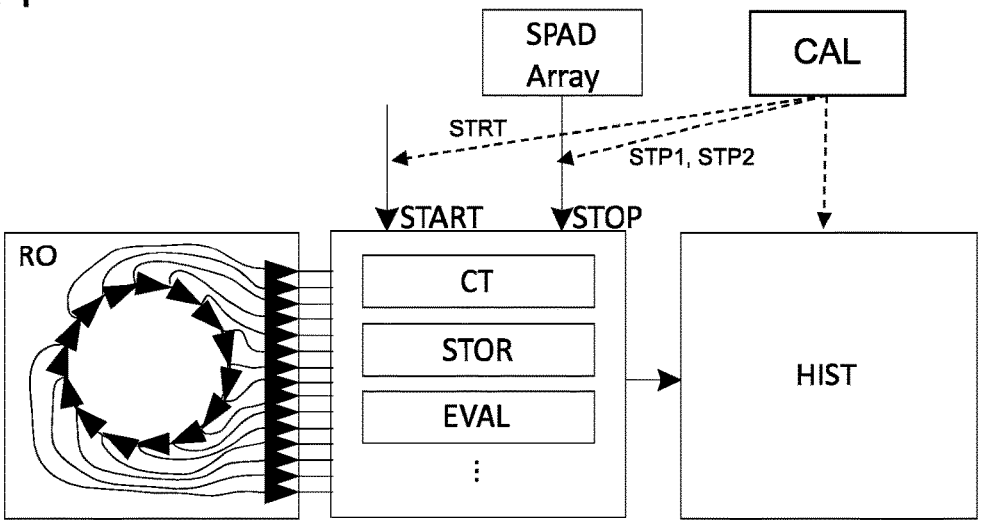
FIG. 1 shows an example embodiment of a time-to-digital converter system according to the improved calibration concept.

FIG. 1 shows an example embodiment of a time-to-digital converter system according to the improved calibration concept. The TDC system comprises a time-to-digital converter with a ring oscillator RO, a counter CT, an evaluation block EVAL with an intermediate storage STOR, and a histogram block HIST connected to the block containing the counter, the evaluation block and the storage.

In this example embodiment, the ring oscillator RO is formed as a fifteen-stage ring oscillator implemented with inverters, each of the inverter outputs connected directly or indirectly with the counter CT, the evaluation block EVAL and the storage element STOR. The ring oscillator RO acts as a fine counter and has one output dedicated to counting clock edges of the ring oscillator by the counter CT, which acts as a coarse counter.

The number of fifteen elements within the ring oscillator RO is chosen arbitrarily for this example and can be readily varied depending on the desired application. For example a switching time of the inverters and the length of the inverter chain determines an oscillator frequency of the ring oscillator RO. For instance, the oscillator frequency may be subject to various process variations such that even ring oscillators manufactured according to the same design may not have the same oscillation frequency within a given precision. The evaluation block EVAL is configured to take a start and a stop signal as a basis for determined a time difference between these signals. For example, an actual state of the ring oscillator RO and the counter CT may be stored in the storage element STOR triggered by the start and stop signals. During a measurement operation, the determined time differences resulting from multiple measurements are stored in the histogram block in respective histogram bins as entries associated with the time difference determined in each case.

Figure 2:
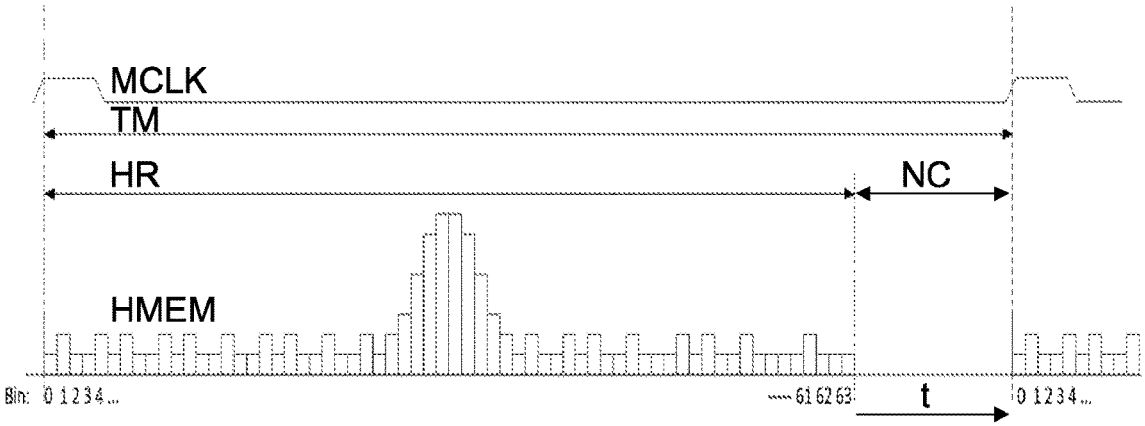
FIG. 2 shows an example time flow diagram for a measurement with a time-to-digital converter system.

Referring to FIG. 2, the start signal may be provided directly or indirectly as a measurement clock signal MCLK that furthermore triggers some kind of radiation-emitting device, in this example e.g. a VCSEL diode for emitting a laser light pulse. Hence the measurement clock MCLK defines a measurement interval TM. With reference to FIG. 1, a stop signal may be provided by a single photon avalanche diode, SPAD, array recording reflections from the radiated pulse. Hence, the time difference between the start and stop signal indicates the time between emission of a pulse and reception of a reflected pulse, thereby providing a measure for a time-of-flight and distance of the object reflecting the radiation.

In the example of FIG. 2, the histogram block has 64 histogram bins. This number should be understood as non-limiting and could be chosen to be either higher or lower. The histogram HMEM shows the result of multiple measurements and the respective distribution in the histogram block HIST. In the diagram of FIG. 2, the 64 histogram bins are shown in relation to the measurement clock MCLK, respectively the measurement interval TM, within a histogram range HR and a non-covered area, respectively time-frame NC, of the measurement interval TM. However, the information about the length of the histogram range HR and therefore the time width of each bin of the histogram block is not known per se but is the result of a calibration process described in the following.

Referring back to FIG. 1, the time-to-digital converter system further comprises a calibration block CAL that provides distinct signals STRT as a start signal and STP1 and/or STP2 as stop signals to the time-to-digital converter for effecting a specific time measure resulting from a time difference between the start and stop signals.

Figure 3:
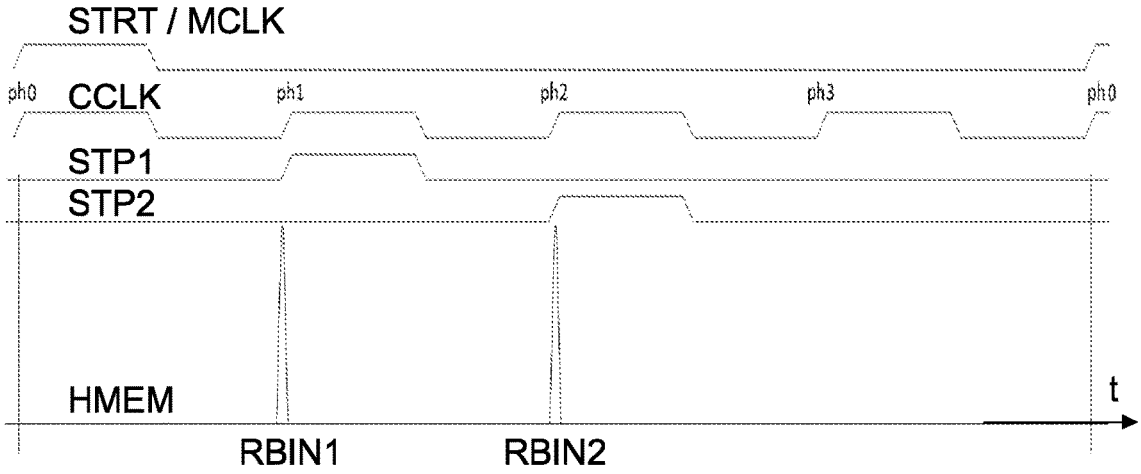
FIG. 3 shows an example time flow diagram for a calibration with a time-to-digital converter system according to the improved calibration concept.

Referring now to FIG. 3, a signal time diagram of a calibration measurement is shown. The start signal STRT may be implemented as a measurement clock signal MCLK or being derived from a calibration clock signal CCLK that has a higher frequency than the measurement clock signal MCLK, in this particular example by a predefined ratio of 4. Accordingly, the calibration clock signal CCLK has four clock edges ph0, ph1, ph2, ph3 in each measurement interval defined by the measurement clock MCLK. The ratio of the calibration clock signal to the measurement clock signal MCLK and/or its frequency value are known.

As mentioned before, the clock edge ph0 of the calibration clock signal CLK is used as or is coincident with the start signal STRT. A first subsequent clock edge ph1 is used as a first stop signal STP1. Employing the functionality of the evaluation block of the time-to-digital converter, the evaluation block EVAL determines a calibration time difference based on the respective clock edges ph0, ph1 of the calibration clock signals CCLK that can be written to the histogram block HIST, respectively the histogram memory HMEM at a specific position RBIN1 associated with the determined calibration time difference. The calibration block CAL is configured to determine a time measure associated with a counter step of the counter based on the predefined ratio between the calibration clock signal CCLK and the measurement clock signal MCLK and the calibration time difference. This may be done directly or by determining the bin number of the histogram block based on the calibration time difference and determining the time measure based on the predefined ratio and the determined bin number RBIN1.

Taking as an example a frequency of the calibration clock signal CCLK to be 160 MHz, resulting at a time between two subsequent clock edges ph1, ph0 of 6.25 ns, and a value of the bin number RBIN1 to be 62, the time measure associated with a single bin would result to:

$$6.25\ \text{ns}/62=100.8\ \text{ps per bin}$$

It should be noted that the time measure can be determined based on the resulting bin number RBIN1 alone, respectively by only evaluating the time difference between the clock edges ph1, ph0. However, in the same manner also a further calibration time difference can be determined based on the time difference between the second stop signal STP2 that is coincident with the clock edge ph2 and the starting clock edge ph0. As can be seen from FIG. 3, this results in a further bin number RBIN2 in the histogram memory HMEM. The time measure associated with the counter step of the counter CT may therefore be determined by employing the difference between the bin number RBIN2 and bin number RBIN1, as also a time difference between the associated clock edges ph1, ph2 is known.

If, to continue the above example, the further bin number RBIN2 is determined with the value 120, the difference between bin numbers RBIN2 and RBIN1 results to 120–62=58, hence the time measure associated with a single bin would result to:

$$6.25\ \text{ns}/58=107.8\ \text{ps per bin}$$

For example, the clock edges used for the calibration measurement are immediately subsequent to each other in each case. However, depending on the frequency of the calibration clock signal CCLK and/or the predefined ratio to the measurement clock signal MCLK, single clock edges may be left out, given that all of the used clock edges fall within the same measurement interval TM.

In the example of FIG. 3, the predefined ratio between the calibration clock signal CCLK and the measurement clock signal MCLK is chosen as 4, which is both an integer number and a power of 2. Such ratio may be beneficial for practical implementations, but nevertheless other ratios are still possible. For instance, if only a time difference between a start pulse and a single stop pulse is evaluated, it may be sufficient that the calibration clock signal has a higher frequency than the measurement clock signal MCLK such that at least two clock edges of the calibration clock signal fall within the measurement interval TM. If two stop signals are to be used, like in the example of FIG. 3 with RBIN1, RBIN2, it may sufficient if the calibration clock signal CCLK is at least twice the frequency of the measurement clock signal MCLK.

It should be apparent to the skilled reader that the time width of each histogram bin corresponds to the time width of each counter step as defined by the oscillator, e.g. the ring oscillator RO. Hence, the time measure determined with the calibration measurement indicates the time for a least significant bit, LSB, which is necessary to convert a histogram result into units of time, e.g. picoseconds, and further on into units of length, e.g. millimeter.

The calibration measurement according to the improved calibration concept can be used for calibrating a TDC system with a single oscillator. However, the improved calibration concept also allows calibrating TDC systems with more than one time-to-digital converter, i.e. more than one oscillator. For instance there are various applications for systems with more than one time-to-digital converter, e.g. for increasing sensitivity of the TDC system by employing the possibility to receive, respectively record, more reflections, or to use several time-to-digital converters independently, e.g. in a multi-pixel configuration.

For multi-pixel implementations with an imaging lens that are effectively low-pixel count 3D-cameras, the histograms would not be merged, but it is nevertheless needed to align the time bases of the pixels.

Figure 4:
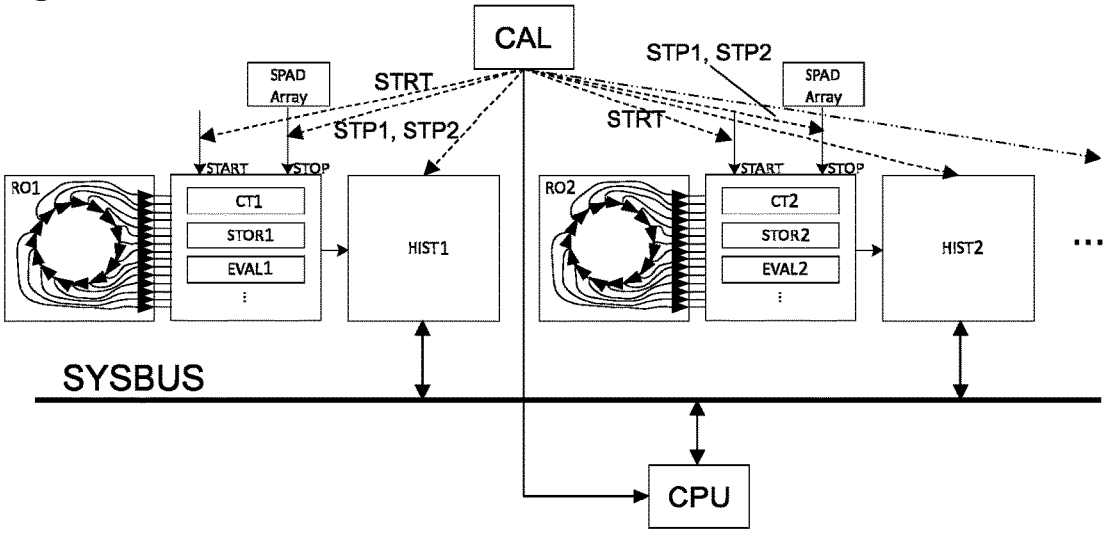
FIG. 4 shows a further example embodiment of a time-to-digital converter system according to the improved calibration concept.

FIG. 4 shows an example of a TDC system with at least two time-to-digital converters, whereas only two of the time-to-digital converters are depicted for better representation.

In particular, the time-to-digital converter system of FIG. 4 is based on the embodiment shown in FIG. 1, whereas the structure of the time-to-digital converter is provided a second time and may be provided several times more as indicated by the ellipsis. In the drawing of FIG. 4, each of the elements of the time-to-digital converters is denoted with reference signs bearing a 1 or 2 behind the reference signs used in FIG. 1 and fulfill the same functionality. In particular, each of the time-to-digital converters performs independent measurements based on respective start and stop signals, the results of the measurements accumulated in the histogram blocks HIST1, HIST2, respectively.

In a similar fashion, the calibration block CAL is configured to provide respective start and stop signals STRT, STP1, STP2 for calibration purposes as described above to the respective inputs of the time-to-digital converters. Accordingly, a time measure associated with the counter step of the respective counter of the time-to-digital converter is determined in each case. For instance, the time measure for each time-to-digital converter can be determined according to one of the approaches described above, i.e. with one or with two stop signals respectively histogram entries.

Figure 5:
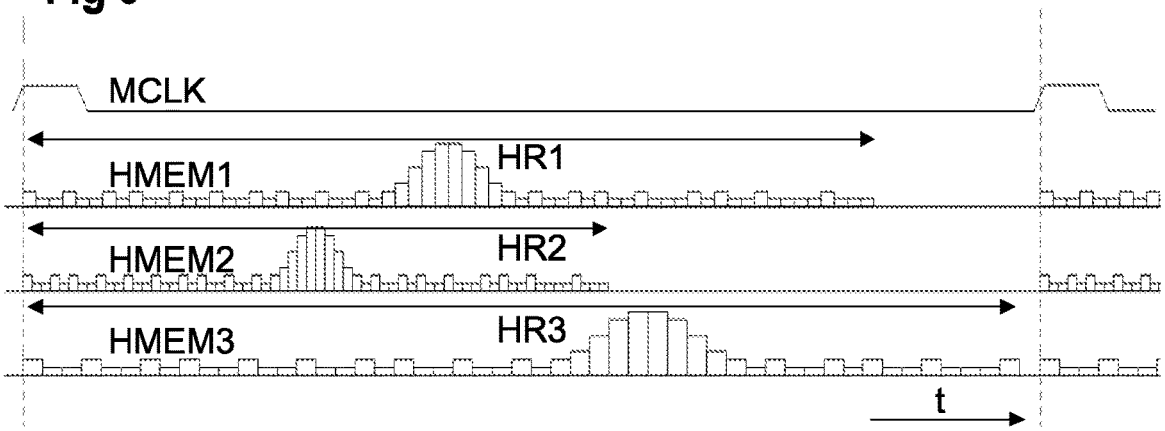
FIG. 5 shows a further example time flow diagram for a calibration with a time-to-digital converter system according to the improved calibration concept.
Figure 6A:
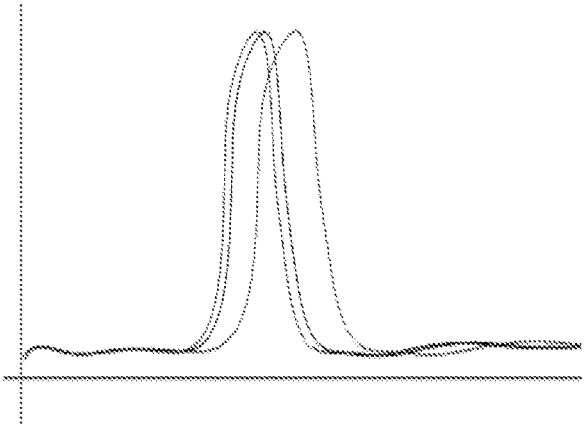
FIG. 6A and FIG. 6B show example histograms in connection with the improved calibration concept.

Referring to FIG. 5, the content of three histogram memories HMEM1, HMEM2, HMEM3 correlated to a measurement clock signal MCLK is shown as an example of a TDC system with three time-to-digital converters. As can be seen from FIG. 5, the three TDCs distinguish at least by their respective histogram ranges HR1, HR2, HR3. Hence, the peak results in the histogram HMEM1, HMEM2, HMEM3 are not coincident with each other, although they are collected in response to the same events respectively under the same conditions. Hence, if the histograms were read out from a CPU over a common system bus SYSBUS as shown in FIG. 4 without the calibration respectively the determined time measures, an overlay of the read-out results would look as shown in FIG. 6A and would therefore introduce inaccurate results.

Figure 6B:
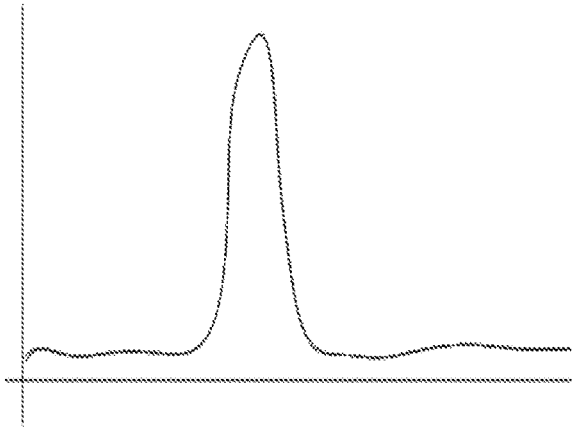

However, according to the improved calibration concept, the determined time measures for each of the time-to-digital converters is provided to the CPU by the calibration block CAL, thereby allowing the alignment of recorded entries in the histogram blocks based on the determined time measures for each TDC. Hence, an overlay of the histogram entries results for example in a coincident distribution as shown in the histogram of FIG. 6B.

Hence, in systems, where e.g. multiple SPAD arrays are connected to respective time-to-digital converters, the results stored in the single histogram blocks may be merged into a common histogram or histogram-like data structure for having more results, i.e. bin entries, thus increasing the sensitivity of the overall system. For the merging process, the results stored in the single histogram blocks are aligned during reading out the entries in the single histogram blocks. In this process, while the histogram entries are denoted with integer bin numbers, the aligned results may be referenced to non-integer addresses, depending on the value of the time measures respectively calibration factors.

In the various embodiments described above, the calibration, i.e. the determination of the time measure associated with the counter steps of the one or more time-to-digital converters can be performed at different times. For example, the calibration could be performed before actually performing a measurement, e.g. immediately before the actual measurement to have a recordation of the situation at the beginning of the measurement. Similarly, the calibration could be performed after an actual measurement, which has a similar effect. Moreover, even a combination of calibration measurements before and after an actual measurement can be implemented, using e.g. mean values of the determined time measures before and after the measurement. The calibration could also be performed in measurement pauses in between different measurement cycles.

All these options allow that the actual measurement results, as e.g. shown as an example in FIG. 5, could be processed after the actual measurement and even outside the time-to-digital converter system using just the raw measurement data collected in the histogram blocks and the associated time measures determined through the calibration measurement.

However, if the calibration measurement is performed before an actual measurement, it is also possible to directly process the outputs of the evaluation block of each TDC and adjust the determined time differences of actual measurements based on the determined time measure before storing them into a histogram. In a variation of that option, the adjusted value of each actual measurement could be directly written to a separate memory. This also allows to write non-integer values that could arise from the adjustment.

The calibration clock signal may be a high speed clock that is globally distributed and carefully balanced. By running the TDCs on two adjacent edges of the clocks, the relative speed of the local ring oscillator can be deduced. Nevertheless, the accuracy of the overall system may be limited by the accuracy of such a high speed clock. Hence, for improving the absolute accuracy considerably, an external high precision clock could be measured, for example a pulse-per-second, PPS, signal that may be provided by a GPS receiver. The measurement of the external high precision clock is then made using the internal high speed clock, i.e. the calibration clock signal.

The invention claimed is:

1. A method for calibrating a time-to-digital converter system with at least one time-to-digital converter comprising an oscillator, in particular a ring oscillator, a counter being driven by the oscillator, an evaluation block connected to the counter and configured for determining a time difference associated with a start signal and a stop signal, and a histogram block with a number of bins for recording entries associated with the time difference, the method comprising:

operating or preparing to operate the time-to-digital converter system with a measurement clock signal defining a measurement interval;

providing a calibration clock signal having a frequency higher than the measurement clock signal by a predefined ratio;

using a selected clock edge of the calibration clock signal as the start signal and a subsequent clock edge of the calibration clock signal as the stop signal;

determining, with the evaluation block, a calibration time difference based on the respective clock edges of the calibration clock signal used as the start signal and the stop signal; and determining a time measure associated with a counter step of the counter based on the predefined ratio and the calibration time difference.

2. The method according to claim 1, further comprising:

determining a bin number of the histogram block based on the calibration time difference; and determining the time measure based on the predefined ratio and the determined bin number.

3. The method according to claim 2, wherein the predefined ratio is at least two, the method further comprising:

using a further subsequent clock edge of the calibration clock signal as a further stop signal;

determining, with the evaluation block, a further calibration time difference based on the respective clock edges of the calibration clock signal used as the start signal and the further stop signal;

determining a further bin number of the histogram block based on the further calibration time difference; and determining the time measure based on the predefined ratio and on a difference between the determined further bin number and the determined bin number.

4. The method according to claim 1, wherein the predefined ratio is at least three or at least four.

5. The method according to claim 1, wherein the predefined ratio is an integer value.

6. The method according to claim 1, wherein the time-to-digital converter system includes a second time-to-digital converter comprising a second oscillator, in particular a ring oscillator, that is independent of the oscillator of the at least one time-to-digital converter, a second counter being driven by the second oscillator, a second evaluation block connected to the second counter and configured for determining a second time difference associated with a second start signal and a second stop signal, and a second histogram block with a number of bins for recording entries associated with the second time difference, the method further comprising:

using the selected clock edge or a further selected clock edge of the calibration clock signal as the second start signal and a corresponding subsequent clock edge of the calibration clock signal as the second stop signal;

determining, with the second evaluation block, a second calibration time difference based on the respective clock edges of the calibration clock signal used as the second start signal and the second stop signal; and determining a second time measure associated with a second counter step of the second counter based on the predefined ratio and the second calibration time difference.

7. The method according to claim 6, further comprising determining a second bin number of the second histogram block based on the second calibration time difference; and determining the second time measure based on the predefined ratio and the determined second bin number.

8. The method according to claim 6, further comprising aligning recorded entries in the histogram block with recorded entries in the second histogram block based on the determined time measure and the determined second time measure.

9. The method according to claim 1, wherein the time measure is a time span determined based further on a frequency value of the calibration clock signal.

10. The method according to claim 9, wherein the frequency value of the calibration clock signal is determined based on a high precision clock signal, in particular a pulse-per-second signal.

11. The method according to claim 1, wherein the determination of the calibration time difference and the determination of the time measure based thereon is performed repeatedly, and wherein a mean time measure is determined from this repeated determination.

12. A time-to-digital converter system, which is operated with a measurement clock signal defining a measurement interval, the system including at least one time-to-digital converter comprising an oscillator, in particular a ring oscillator, a counter being driven by the oscillator, an evaluation block connected to the counter and configured for determining a time difference associated with a start signal and a stop signal, a histogram block with a number of bins for recording entries associated with the time difference, and a calibration block configured for:

providing a selected clock edge of a calibration clock signal, which has a frequency higher than the measurement clock signal by a predefined ratio, to the evaluation block as the start signal and a subsequent clock edge of the calibration clock signal as the stop signal;

receiving from the evaluation block a calibration time difference based on the respective clock edges of the calibration clock signal used as the start signal and the stop signal; and determining a time measure associated with a counter step of the counter based on the predefined ratio and the calibration time difference.

13. The system according to claim 12, wherein the predefined ratio is at least two and the calibration block is further configured for:

determining a bin number of the histogram block based on the calibration time difference;

providing a further subsequent clock edge of the calibration clock signal to the evaluation block as a further stop signal;

receiving from the evaluation block a further calibration time difference based on the respective clock edges of the calibration clock signal used as the start signal and the further stop signal;

determining a further bin number of the histogram block based on the further calibration time difference; and determining the time measure based on the predefined ratio and on a difference between the determined further bin number and the determined bin number.

14. The system according to claim 12, further including a second time-to-digital converter comprising a second oscillator, in particular a ring oscillator, that is independent of the oscillator of the at least one time-to-digital converter, a second counter being driven by the second oscillator, a second evaluation block connected to the second counter and configured for determining a second time difference associated with a second start signal and a second stop signal, and a second histogram block with a number of bins for recording entries associated with the second time difference, wherein the calibration block is further configured for:

providing the selected clock edge or a further selected clock edge of the calibration clock signal to the evaluation block as the second start signal and a corresponding subsequent clock edge of the calibration clock signal as the second stop signal;

receiving from the evaluation block a second calibration time difference based on the respective clock edges of the calibration clock signal used as the second start signal and the second stop signal; and determining a second time measure associated with a second counter step of the second counter based on the predefined ratio and the second calibration time difference.

15. The system according to claim 14, wherein the calibration block is further configured for aligning recorded entries in the histogram block with recorded entries in the second histogram block based on the determined time measure and the determined second time measure.

* * * * *